US010845104B2

(12) United States Patent
Valdez

(10) Patent No.: US 10,845,104 B2
(45) Date of Patent: Nov. 24, 2020

(54) COOLING SYSTEM FOR AIR CONDITIONER

(71) Applicant: Raymond Armstrong Valdez, Indio, CA (US)

(72) Inventor: Raymond Armstrong Valdez, Indio, CA (US)

( * ) Notice: Subject to any disclaimer, the term of this patent is extended or adjusted under 35 U.S.C. 154(b) by 99 days.

(21) Appl. No.: 16/251,059

(22) Filed: Jan. 17, 2019

(65) Prior Publication Data

US 2019/0226729 A1 Jul. 25, 2019

Related U.S. Application Data

(60) Provisional application No. 62/619,688, filed on Jan. 19, 2018.

(51) Int. Cl.

| | |
|---|---|
| ***F25B 31/00*** | (2006.01) |
| ***F04B 39/06*** | (2006.01) |
| ***F24F 11/89*** | (2018.01) |
| ***F04B 35/04*** | (2006.01) |
| ***F04B 49/02*** | (2006.01) |
| *F25B 49/00* | (2006.01) |

(52) U.S. Cl.

CPC ..... *F25B 31/008* (2013.01); *F04B 35/04* (2013.01); *F04B 39/06* (2013.01); *F04B 39/064* (2013.01); *F04B 49/02* (2013.01); *F24F 11/89* (2018.01); *F04B 2201/0801* (2013.01); *F25B 49/005* (2013.01); *F25B 2400/07* (2013.01); *F25B 2500/05* (2013.01)

(58) Field of Classification Search

CPC .. F25B 31/008; F25B 31/006; F25B 2400/07; F25B 2500/05; F04B 2201/0801; F04B 39/06; F04B 39/064; F04B 49/02; F04B 39/121; F04B 39/123; F24F 11/89

See application file for complete search history.

(56) References Cited

U.S. PATENT DOCUMENTS

| | | | | |
|---|---|---|---|---|
| 6,263,664 | B1 * | 7/2001 | Tanigawa | F23R 3/005 60/39.54 |
| 8,371,828 | B2 * | 2/2013 | Hebrard | B22D 19/0072 417/366 |
| 2014/0212309 | A1 * | 7/2014 | Hamilton | F04B 39/121 417/415 |
| 2018/0087493 | A1 * | 3/2018 | Repaci | F04B 39/121 |

* cited by examiner

*Primary Examiner* — Jon T. Schermerhorn, Jr.
(74) *Attorney, Agent, or Firm* — Eric Hanscom

(57) ABSTRACT

The present invention relates to a portable water dispenser for dispensing cooling water to an overheated compressor of an ACU. The water dispenser includes a splash guard and a core that is installed inside the splash guard. The core includes a magnet that firmly but temporarily attaches the water dispenser to the outer surface with the compressor. Water flow is controlled to convert the flow exiting a water hose into a uniformly distributed curtain covering the entire outer surface of the compressor. The splash guard prevents water loss because it redirects any splashes towards the compressor.

14 Claims, 11 Drawing Sheets

COOLING SYSTEM FOR AIR CONDITIONER

RELATED PATENTS AND APPLICATIONS

This application claims priority from US provisional application 62/619,688 filed on Jan. 19, 2018.

FIELD OF THE INVENTION

This specification describes a cooling system for the compressors of air conditioners.

BACKGROUND

A system that cools air and ventilates cooled air through a structure, is referred to as a heating, ventilation and air conditioning unit (HVAC). An HVAC unit may be installed at structures such as houses or large buildings to cool and ventilate the enclosed spaces inside these structures, referred to hereinafter as an airconditioned space. In most HVAC systems, air is drawn in, filtered, cooled and then delivered to the air-conditioned space. An HVAC uses a refrigerant for cooling. In the cooling process, the refrigerant in a fluid phase is driven to evaporate. When evaporating, the refrigerant absorbs the surrounding heat. Then, the refrigerant in the gaseous state is condensed back to the liquid state, during which it emits heat. The cycle is repeated to the extent required for a desired temperature to be obtained in the air-conditioned space.

Taking a house as an example of a cooled and ventilated structure, an HVAC system 100 is generally installed at a house as shown in FIG. 1A. The HVAC system 100 of FIG. 1A is a 'split' system, comprising a "hot" unit, generally referenced as an air conditioner unit (ACU) 101 which is installed outside the house, and which is where condensation of the refrigerant occurs. The HVAC system 100 also comprises a "cool" unit, generally referenced as an air handler unit 102, which is installed inside the house, and which is where evaporation of the refrigerant occurs.

The air is drawn in from the house into the air handler unit 102, as shown by the arrows "A", at a warm temperature. It is blown through the air handler unit 102, where it is cooled by being exposed to the refrigerant and is then forced by a blower/fan 103 from the air handler unit 102 unit to the air-conditioned space, as shown by the arrows "B", at a cooler temperature.

FIG. 1B illustrates the main components of an HVAC system which comprises four main components: an evaporator 110, a compressor 105, a condenser 107 and a metering device 113. The HVAC system 100 uses a refrigerant 108 which circulates through tubing in gaseous form 108-1, shown by pointed line in FIG. 1B, or liquid form 108-2, shown in black on FIG. 1B. Specifically, the refrigerant in the liquid phase and at a relatively low temperature is pumped by the compressor 105 to the evaporator 110 of the air handler unit 102. The refrigerant evaporates when inside the evaporator 110, as it is exposed to the warmer air inside the house as that air is drawn into the air handler unit 102. During evaporation, as the refrigerant 108 is converted from the liquid phase to a gaseous phase, it absorbs the heat from the surrounding environment, including the air drawn into the air handler unit 102. Specifically, the refrigerant acts as a sponge to absorb heat from the warm air as it is pushed through by blower/fan 103 through the coils of the evaporator 110 of air handler unit 102. The resulting cooler air is then blown back into the air-conditioned space by the blower/fan 103. With the latent heat in the previously warmer air now absorbed by the refrigerant, the refrigerant 108 flows to the ACU 101 in the gaseous phase, as shown by the dotted lines inside tubing.

The ACU 101 then cools the warm refrigerant that was just used to cool the air. Specifically, the refrigerant 108 in the gaseous phase and at a relatively hot temperature is pumped by compressor 105 from the air handler unit 102, through the coils of the condenser 107, which condenses the refrigerant 108, i.e. it converts it from the gaseous phase back to a liquid phase. In this process, latent heat is transferred from the previously warmer refrigerant to the surrounding environment, which includes air outside the ACU 101. The air in the surrounding environment acts as a sponge to absorb the heat from the refrigerant as it converted back to the liquid phase. The ACU 101 then expels the resulting warmer air outside the airconditioned space, using a fan 106. With the latent heat now removed from the refrigerant, the refrigerant has a cooler temperature, and is sent in the liquid phase back to the air handler unit 102. The ACU 101 thus continuously converts the refrigerant from the gaseous phase to the liquid phase and the evaporator converts back the refrigerant from the liquid phase to the gaseous phase, resulting in cooling the air-conditioned space and blowing the hot air outside the space. As indicated above, the ACU 101, is typically placed outside the air-conditioned space as shown in FIG. 1A.

The compressor 105 is the heart of the ACU 101. The compressor 105 typically is an electric pump that pressurizes the refrigerant gas and moves it through the HVAC system 100.

FIG. 1B also show a metering device 113 arranged in the flow of the liquid refrigerant. The metering device 113 of the air handler unit 102 controls the flow of the cooled liquid refrigerant 108 from the ACU 101 to the air handler unit 102, using a thermostat 117 (seen in FIG. 1A) that is located inside the air-conditioned space. Thermostat 117 is used in a feedback loop by measuring the temperature of the air-conditioned space, and based on its measurements, enabling or disabling operation of the compressor. In this way, the ACU 101 and air handler unit 102 cooperate to maintain the air-conditioned space at a desired temperature.

Importantly, the ACU 101 also comprises a thermal overload protection relay 109, that cuts the power to the compressor when it detects overheating. The thermal overload protection relay 109 power from a source (not shown in FIG. 1A) and controls the electricity to going an electric motor of the compressor 105. Further, the thermal overload protection relay 109 automatically shuts off the compressor 105 after a predetermined time period to prevent overheating of the compressor 105. A conventional thermal overload protection relay 109 includes three terminals, namely 'run' terminal represented by 'R', 'common' terminal represented by 'C', and 'start' terminal represented by S. Further, the terminal C acts as a relay that cuts off the supply of electricity in an event of the overheating of the compressor 105. During the running of the compressor, the operation of the thermal overload protection relay 109 is triggered when a temperature sensor in the ACU 101 determines that the compressor is overheated. Such overheating of the compressor 105 is called "thermal overload". Overheating may be caused by mechanical problems with the compressor, blocked refrigerant fluid, or high ambient temperatures near the ACU 101 which make the compressor 105 work for extended periods of time. When thermal overload is detected, a relay is tripped that disconnects the compressor from its electric power source. When the compressor 105 has cooled down to a temperature within the set operating range, the internal thermal overload protection relay 109 is reset completing the circuit and once again restoring power to the compressor 105. It is to be noted that though the overload protection relay 109 is shown in FIG. 1B on the compressor 109 for illustrative purposes, it is generally placed inside the compressor 109.

Generally, when the thermal overload relay is tripped it can take up to six hours to reset on its own to allow electric power to flow to the condenser 107 once again, depending on the ambient temperature just outside the ACU 101. This results in long periods of time during which the air conditioner is shut off, allowing the temperature of the air-conditioned space to rise to an unacceptable level. During this time, problems with ACUs may not be diagnosable by a visiting HVAC technician since the ACU remains inoperable until the compressor cools down, thermal overload is rectified and the condenser 107 is once again electrically powered and operational.

There are only a few known and practiced ways to speed up the cooling down of a compressor. The most common and effective way to accelerate the cooling and expedite the repair of the compressor 105, is to cool it by spraying it with a steady supply of water from a cold-water tap, typically through a garden hose. In places where the ambient temperature is high for extended periods of time, and where compressors tend to overheat often, this solution results in long periods of time during which the HVAC is not cooling air-conditioned space, a technician cannot diagnose the compressors, and water is being wastefully consumed just to cool the compressor. As an example, in the hotter parts of the American southwest region, a compressor may require up to 45 minutes of exposure to water from a garden hose before its operation can be restored.

The compressor cooling time cannot be decreased by merely increasing the pressure of the water flow, which only increases the rate at which water is expelled from the garden hose. If the water pressure is raised to high, most of the applied water will bounce off the compressor, not having achieved its intended purpose of coating the entire surface of the compressor. As a result, the cooling process would take even longer, and even more water is wasted.

Another problem with current methods of cooling the compressor is that the methods typically require an ACU technician to manually hold the water hose in place for a very long time (i.e., up to 45 minutes), and keep it in a precise locked position for the entire duration of the cooling process, so that the flowing water hits the top of the compressor at an optimal angle. Holding the aforementioned water hose in a precise locked position for up to 45 minutes is very uncomfortable for the technician, especially during the sort of hot day that is often associated with thermal overload of a compressor. In addition, the angle of incidence of the water on the compressor needs to be selected and maintained to try to obtain an even curtain of water to flow across the entire surface of the compressor, including the top surface of the compressor that is directly exposed to the water from the garden hose, and the side surfaces of the compressor which receive water that comes from the top surface.

Still further, in order to obtain an efficient cooling of the compressor, its entire surface needs to be covered by an even coating of water, as this ensures the fastest rate of cooling of the compressor, since it eliminates all hot spots from the compressor. It is difficult to achieve this by directly spraying water on the compressor with a garden hose.

Some solutions proposed for addressing this problem are presented next. For example, U.S. Pat. No. 4,240,265 describes use of a spray nozzle which automatically applies a mist of water, or another appropriate liquid, to the condenser coils, before the ACU reaches a thermal overload. Thus, whenever the temperature in the ACU, measured by a temperature sensor, starts to approach a temperature indicative of thermal overload, a valve that is part of the air conditioning unit opens, thus permitting water to be sprayed through a nozzle on the condenser for a period of time, until its temperature drops to a lower level. Such a solution however, is costly as it involves costly changes to an off-the-shelf ACU including connecting it to the water supply of the building near which the ACU is located.

A need thus exists for a technology that rapidly cools an overheated compressor, particularly in high-temperature geographical regions where it is more difficult to cool compressors using ambient air (which is too warm in such regions). The solution should not increase the cost of the ACU and should be readily available to a visiting HVAC technician.

SUMMARY

The present specification relates generally to an apparatus and method for a portable means of cooling the compressor of an air conditioner system with a view to boosting efficiency of the compressors of air conditioners.

It is an object of this specification to provide for efficient and rapid cooling of the ACU compressor. It is a further objective to achieve cooling of the ACU compressor with a minimal amount of cooling water and in a manner that does not require extensive or expensive modifications of off-the-shelf ACUs.

It is a further object of this specification to provide an apparatus and method for cooling and ACU compressor that is portable and that can be easily operated, enabling the ACU technicians to repeatedly use the apparatus and method at numerous sites for enabling maintenance and repair of the respective ACUs after shorter times necessary for cooling the compressor.

Accordingly, the above objects are achieved with a water dispenser for cooling a compressor of an ACU. The water dispenser includes a connector adapted to fluidically couple a hose to the water dispenser. In addition, the water dispenser includes a core fluidically coupled to the connector and is adapted to dispense water received from the connector. The water dispenser also includes a splash-guard surrounding the core. In one example, the splash-guard includes a first splash-guard end that couples to the core such that a partially enclosed space is defined between the core and the splash-guard. Further, the extends through the core such that a fluid opening is formed at a second splash-guard end, opposite to the first splash guard end. The water dispenser also includes a magnet having a first magnet-end that is coupled to the core and a second magnet-end that protrudes from the fluid opening and is adapted for temporary attachment to the compressor. In one example, the partially enclosed space and fluid opening are shaped to cause the received water to exit the water dispenser through the fluid opening as a coating that covers at least part of the compressor.

BRIEF DESCRIPTION OF THE DRAWINGS

The drawings accompanying and forming part of this specification are included to depict certain aspects of the invention. A clearer Impression of the apparatus and method described therein will become more apparent by referring to the exemplary and therefore non-limiting embodiments illustrated in the drawings. Note that the features illustrated in the drawings are not necessarily drawn to scale.

DETAILED DESCRIPTION

The various features and advantageous details of the proposed devices, systems and methods are explained more fully with reference to the non-limiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating some embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Figure 1A:
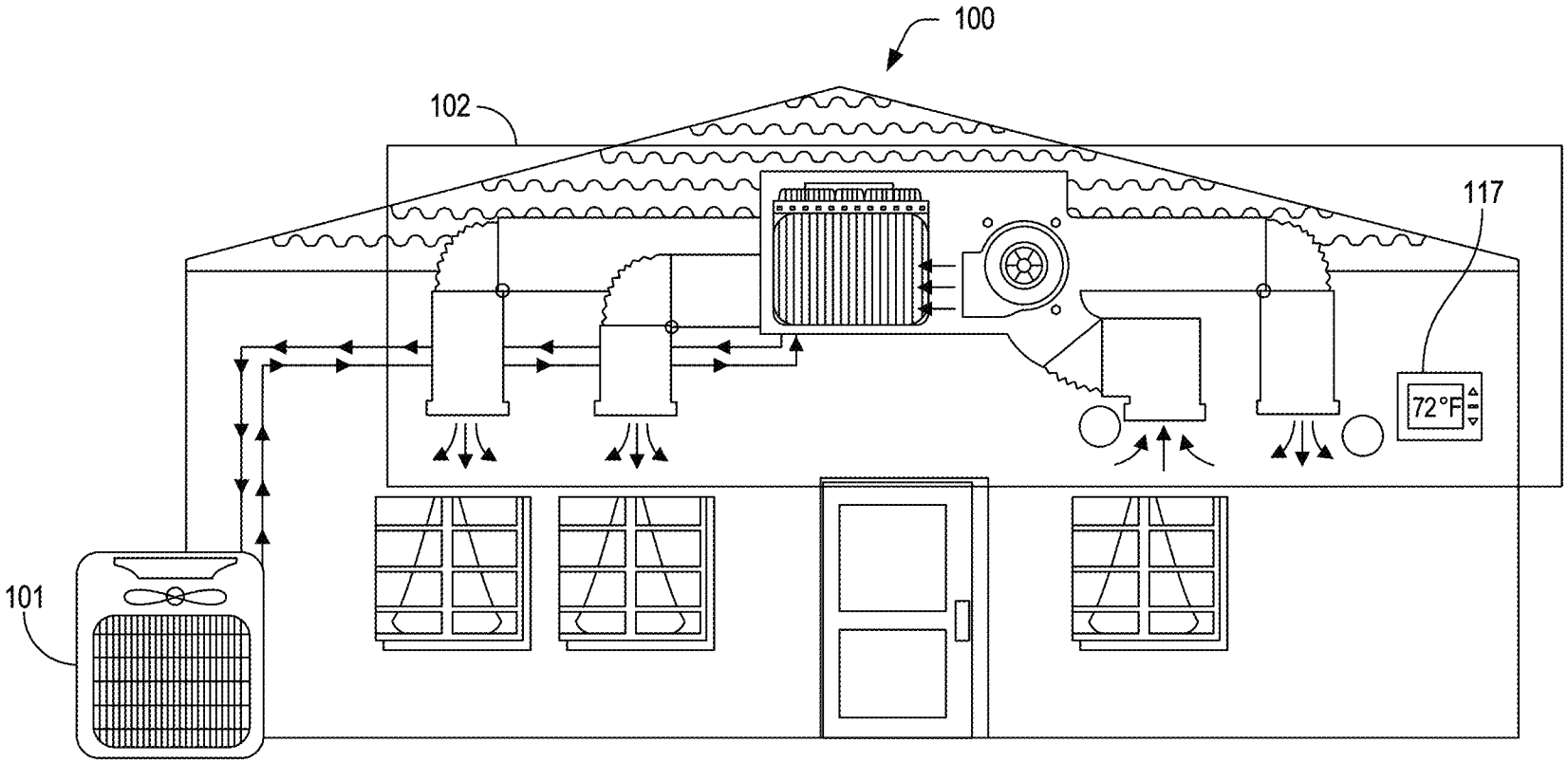
Fig. 1A (Prior Art)
FIGS. 1A and 1B illustrate a conventional HVAC system.
Figure 1B:
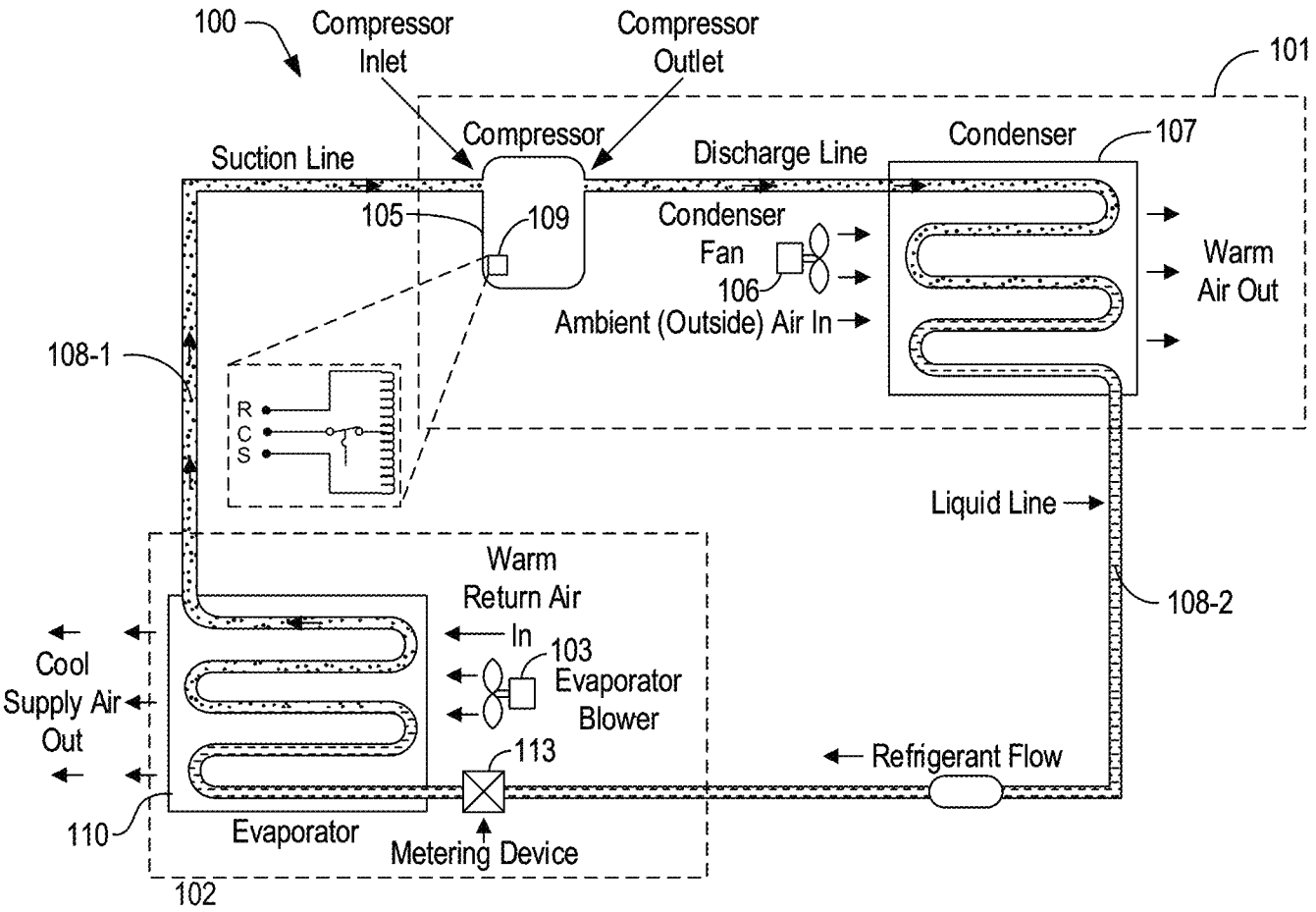
Fig. 1B (Prior Art)
Figure 2:
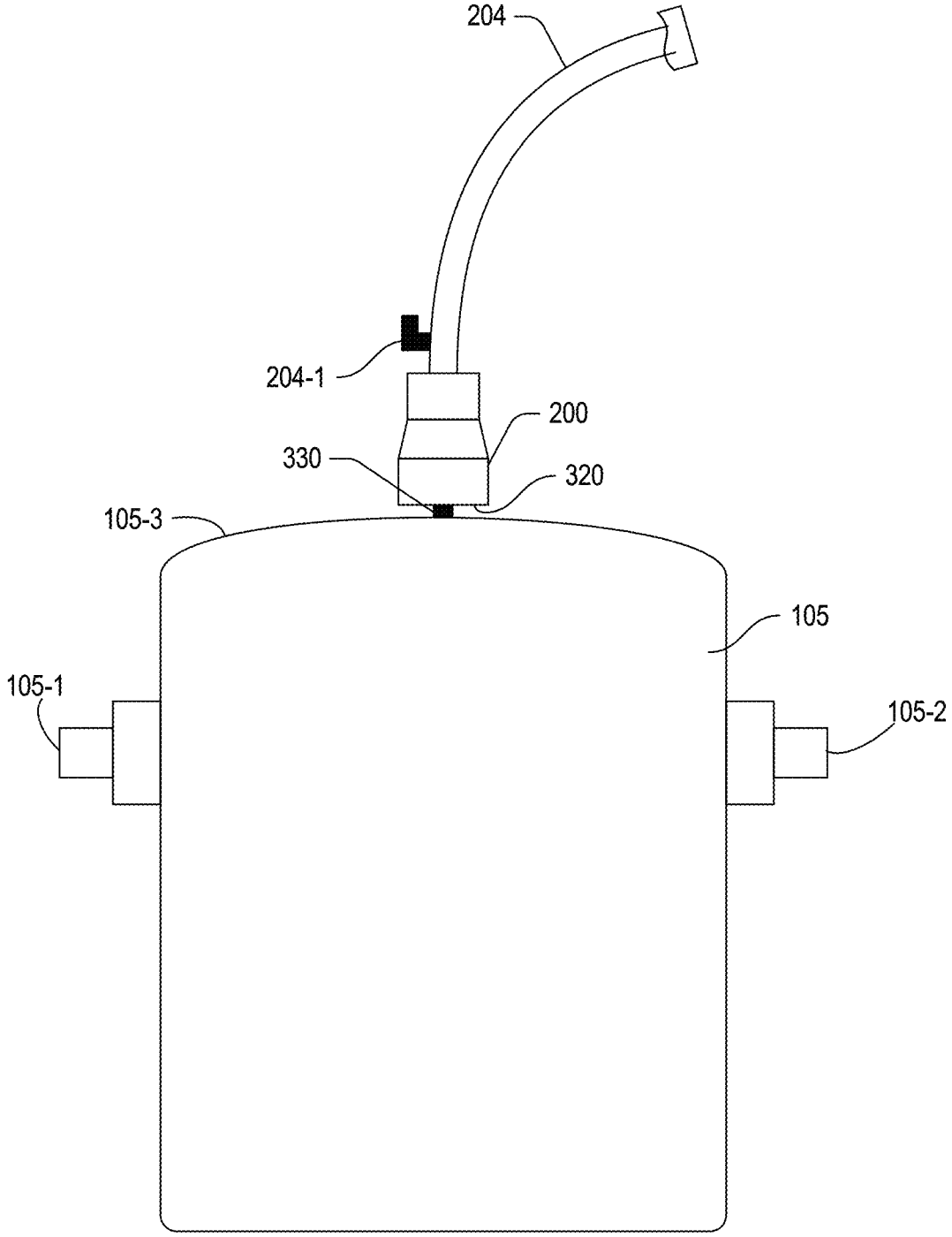
FIG. 2 illustrates a compressor with an embodiment of the water dispenser installed thereon.

Embodiments of the water dispenser for air conditioners proposed in this specification are described hereafter, and illustrated in FIGS. 2, 3A, 3B, and 4A to 4C. In general terms, the water dispenser includes a substantially bell-shaped housing, which attaches to a water hose, and a core, fixed inside the housing, shown in FIGS. 3A, 3B, 4*a*-4C. The core provides a plurality of water channels, which direct the water flow from a hose over the surface of the compressor 105 so that it flows uniformly over the compressor 105, when the water dispenser 200 is attached to water hose 204 and placed on the compressor 105. A water tap 204-1 is preferably provided for conveniently opening and closing the water input to the water dispenser. The housing includes an inlet 105-1 that receives the refrigerant coming from the evaporator 110 and an outlet 105-2 that discharges the compressed refrigerant to the condenser 107. A magnet (not shown) inside the water dispenser 200 is used to hold the water dispenser 200 in place, and in contact with the compressor 105, which includes enough metal to attract the magnet. Therefore, the water dispenser is positioned so it is contacting the compressor 105 in a "hands-free" manner that does not require a person such as a technician to hold the water dispenser in place for cooling the compressor 105. Notably, by using a magnet to hold the water dispenser 200 attached to the compressor 105, the technician has a portable means of cooling the compressor that can be firmly but temporarily attached to the compressors 105 with ease, and that can also be easily removed after the technician finished servicing the ACU 101. FIG. 2 also illustrates a fluid opening 320 formed between the water dispenser 200 and the compressor 105, that creates a dispensing opening that allows water to flow out from the water dispenser 200 along the surface of the compressor 105. Thus, when the compressor 105 gets overheated due to high load and/or high ambient temperature, the water dispenser 200 is attached to an outer surface 105-3 of the compressor 105. The water dispenser 200, in operation, delivers water from water hose 204 to the compressor 105 in such a manner that the water is uniformly distributed as a film that coats the outer surface 105-3 with a thick curtain of water, thereby providing uniform and efficient cooling of the compressor 105.

Figure 3A:
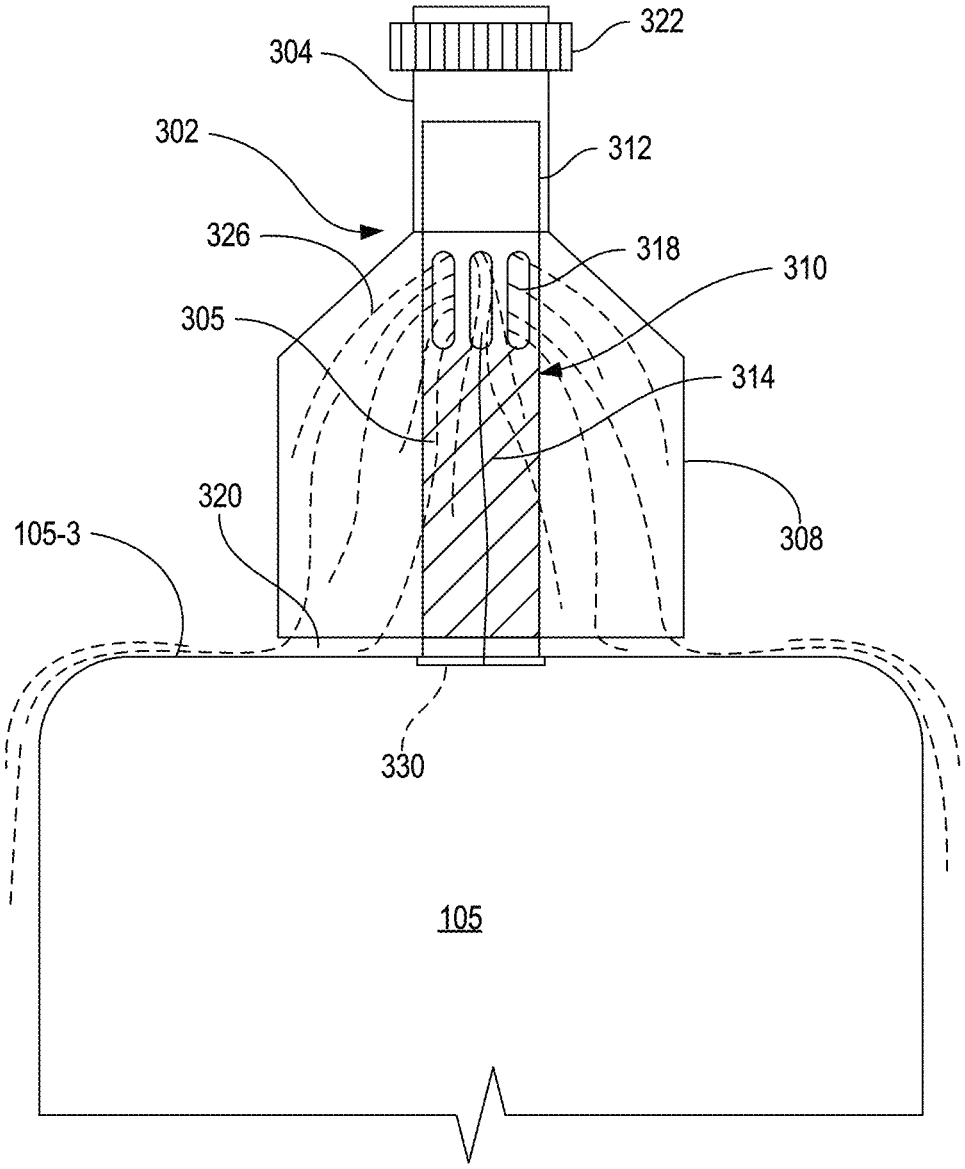
FIGS. 3A and 3B illustrate an embodiment of the water dispenser.
Figure 3B:
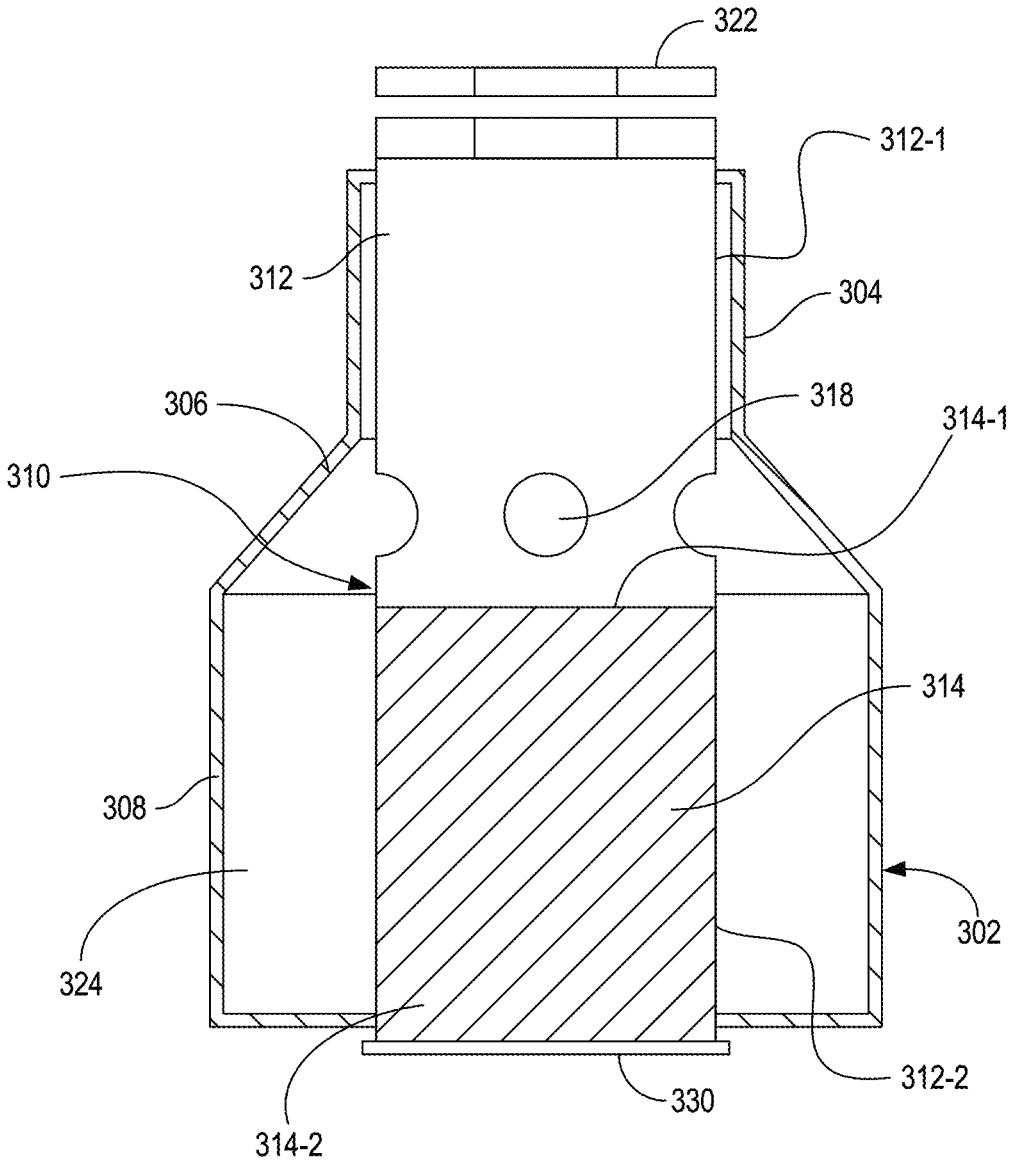

The structural details of an embodiment of the water dispenser 200 and the manner in which the water dispenser 200 uniformly distributes cooling water, are described next in connection with FIGS. 3A and 3B. FIGS. 3A and 3B illustrate the water dispenser 200 according to a preferred embodiment and FIG. 3B illustrates a cut section of the water dispenser 200. The water dispenser 200 includes a splash guard 302, a core 310 with a magnet 314, and a connector 322.

The splash guard 302 directs the cooling water on the outer surface 105-3 of the compressor 105 as seen in FIG. 3A. The splash guard 302 substantially surrounds the core 310. The splash guard 302 includes a neck portion 304 (see FIG. 3A), a frustum shaped portion 306 (see FIG. 3*b*) and a splash-containing portion 308. In one example, the frustum shaped portion 306 extends from one end of the neck portion 304 while the splash guard portion extends from an end of the frustum shaped portion 306 opposite to an end connected to the neck portion 304. The neck portion 304 allows a user to hold and place the water dispenser 200 on the compressor 105. In one example, the neck portion is sized for enabling handling of the water dispenser by an operator. Preferable, the length of the neck portion 304 may be about an inch; different sizes are also possible. The frustum shaped portion 306 has the small diameter at the side of the neck portion 304 and the large diameter connected to the splash-containing portion 308 that directs the water flow towards the compressor 105. The inner diameter of the cylindrical splash-containing portion 308 is 2 inches in a preferred embodiment of the invention. The dimensions of the frustum shaped portion 306 are selected to provide an adequate coating of the cooling water as it flows over the outer surface 105-3 of the compressor 105. For example, in a preferred embodiment, the height of the frustum shaped portion 306 could be ¾ inch. It is to be understood that other sizes for the splash guard (housing) 302 may be envisaged, having in view a desired thickness of the water coating and the design of the core 310.

As indicated above, the water dispenser 200 also includes the core 310 fixed or assembled inside the splash guard 302. The core 310 is assembled inside the splash guard 302 such that a partially enclosed space (or chamber) 324 is formed between the core 310 and the splash guard 302. The core 310 and the splash guard 302 are sized in such a manner that the core 310 protrudes from the splash guard 302, to form a cylindrical fluid opening 320 between the splash guard 302 and the compressor 105 when the water dispenser is placed on the compressor. The fluid opening 320 allows the water to flow out of the water dispenser 200 as a curtain of water that covers the compressor 105. The fluid opening 320 determines the thickness of the water coating. In one embodiment, the fluid opening 320 is ¼th of an inch. This ensures that the water is delivered evenly on the outer surface 105-3 of the compressor 105 to provide uniform and efficient cooling of the compressor 105.

The core 310 includes a tubular piece 312, with a "hose" end 312-1 coupled to the neck portion 304 of the splash guard 302 and adapted to be connected to the hose 204 (see FIG. 2), and the other "magnet-retaining" end 312-2, closed off and adapted to securely retain the magnet 314. In FIG. 3B, the magnet 314 retained inside a magnet retention section 305 of the tubular piece 312 is shown in cross-section. The magnet 314, is surrounded by the tubular piece 312. That is, in a preferred embodiment, the magnet 314 is shaped and sized to slot into, and be retained inside, the tubular piece 312, with its longitudinal tip abutting against the inside of the magnet-retaining end 312-2 of the tubular piece 312. Though the magnet 314 can be welded, glued or otherwise attached to the tubular piece 312 in alternative embodiments, slotting the magnet 314 into the tubular piece 312 has the advantage of not having to create a connection between the magnet 314 and the tubular piece 312 that might corrode as it is exposed to water over time. In one example, the hose end 312-1 of the tubular piece 312 is shaped to be press-fit into the neck portion 304. In another example, the hose end 312-1 of the tubular piece 312 is threaded into the neck portion 304, as shown by way of example in FIGS. 4A and 4B. In another example, the hose end 312-1 of the tubular piece 312 is welded to the neck portion 304.

The tubular wall of the tubular piece 312 also includes a plurality of holes 318 that are formed in a part of the tubular piece 312 that is not directly touching the magnet 314. The holes 318 are shown as oval slots in FIG. 3A and as circles in FIG. 3*b*. Other shapes of the hole 318 can also be envisaged; it is important to hat all holes 318 have a similar shape and are distributed evenly along the circumference of the tubular piece 312. During operation, water flow entering the neck portion 304 of the core 310 comes out from the holes 318. The water comes out of the holes 318 under high pressure, and splashes against the frustum shaped portion 306. The splash guard 302 deflects the water to generate a thick steady water flow, that is not splashing about, and that uniformly coats the compressor after it exits the water dispenser 200, out through fluid opening 320. In one example, the tubular piece 312 has four holes spaced 90 degrees from one another, and the diameter of each hole 318 is ⅜ inch. It is to be understood that embodiments with a greater or smaller number of holes can also be provided, and that the size of the holes can be varied. For example, in an embodiment with three holes 318, the holes may be spaced apart by 120 degrees. As shown, the holes 318 are provided at the level of the frustum shaped portion 306 of the splash guard 302 when the core is attached into the housing. In this way, the water exiting the holes 318 as water streams 326 is deflected by the angular walls of frustum shaped portion 306 towards the exit. This facilitates generation of a uniform coating of water for dissemination over the compressor 105. The characteristics of the water coating are determined in part by the size of a fluid opening 320, defined by the vertical distance between the down-most part of the splash guard 302, and the down-most part the core 310.

The water dispenser 200 also includes the connector 322 that allows the water hose 204 (shown in FIG. 2) to connect to the water dispenser 200. In one example, the connector 322 is made of brass and can be press fitted into the neck portion 304. Alternatively, the connector 322 can be threaded into the hose end 312-1 of the tubular piece 312, for example in embodiments where tubular piece 312 is designed to extend outside of neck portion 304. As well, the connector 322 can be threaded inside the hose end 312-1 of the tubular, to engage the external threads of a matting connector on the hose, as seen for example in FIGS. 4A and 4B. In one example, the connector 322 may be coupled to the core 310 at the end proximate to the neck portion 304 as shown in FIG. 4B.

A cap, shown at 330 on FIGS. 3A and 3B, may also be provided to form the magnet-retaining end 312-2 of the tubular piece 312. The cap 330 can be shaped to snugly fit the slightly curved surface that typically characterizes compressors.

In one example, the magnet 314 has a first magnet-end 314-1 that is coupled to the magnet-retaining end 312-2 of the tubular piece 312 of the core 310. In addition, the magnet has a second magnet-end 314-2 that protrudes from the fluid opening 320 to temporarily attach the water dispenser 200 with the compressor 105. Further, the second magnet-end 314-2 is shaped to magnetically attach the water dispenser 200 to the compressor 105. There are numerous ways to attach the magnet 314 to the tubular piece 312. For example, the magnet 314 may be attached just by its magnetic force. It may also be glued to the tubular piece 312. Other attachment means could also be envisioned by the persons skilled in the art. The magnet 314 is preferably cylindrically shaped to slot into the tubular piece 312. In the embodiment shown in FIGS. 3A and 3B, the diameter of the magnet is selected to snugly fit within the tubular piece 312 of the core 310, without covering the holes 318. The magnet 314 is also selected to have a magnetic field that is strong enough to firmly attach the water dispenser 200 to the compressor 105 while in operation dispensing water. In one example, the magnet 314 is a rare-earth magnet, such as neodymium magnet of various grades, such as grade G35, G38, G40, G42, G45, or the like.

Figure 4C:
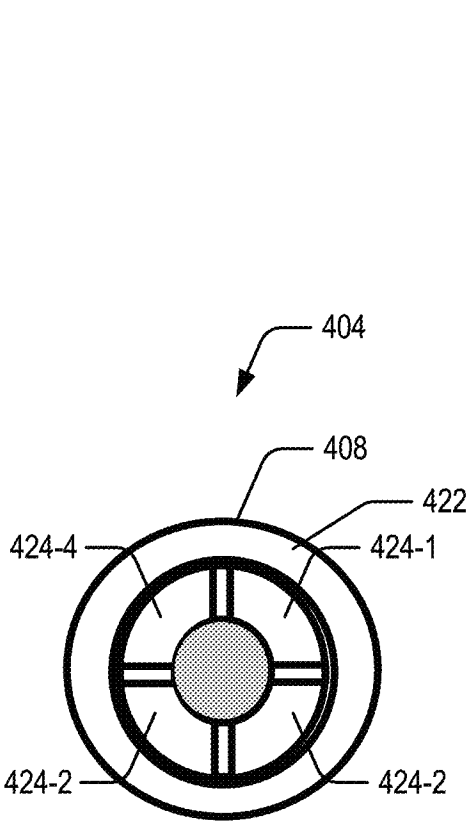
FIGS. 4A to 4C illustrate another possible embodiment of the water dispenser.
Figure 4B:
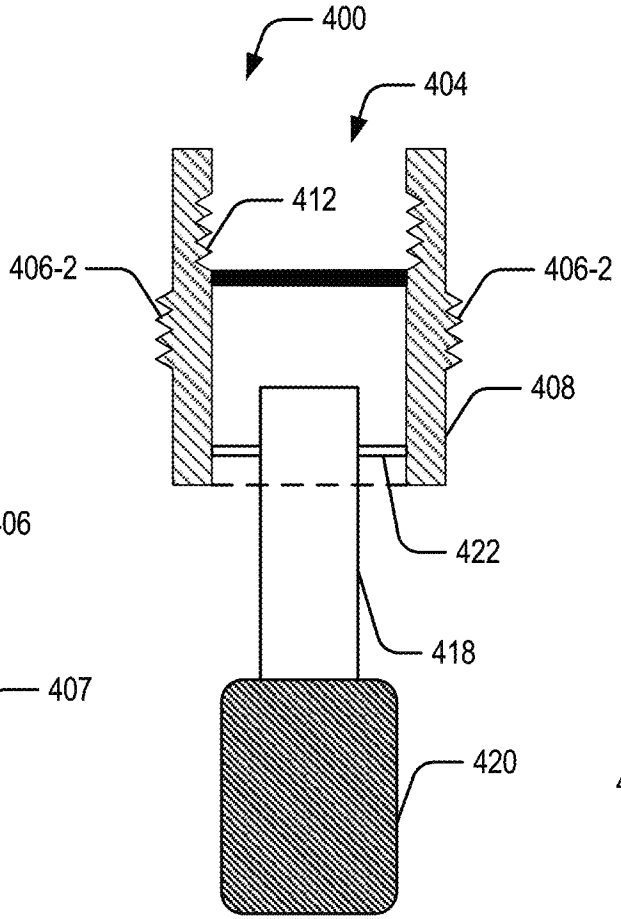
Figure 4A:
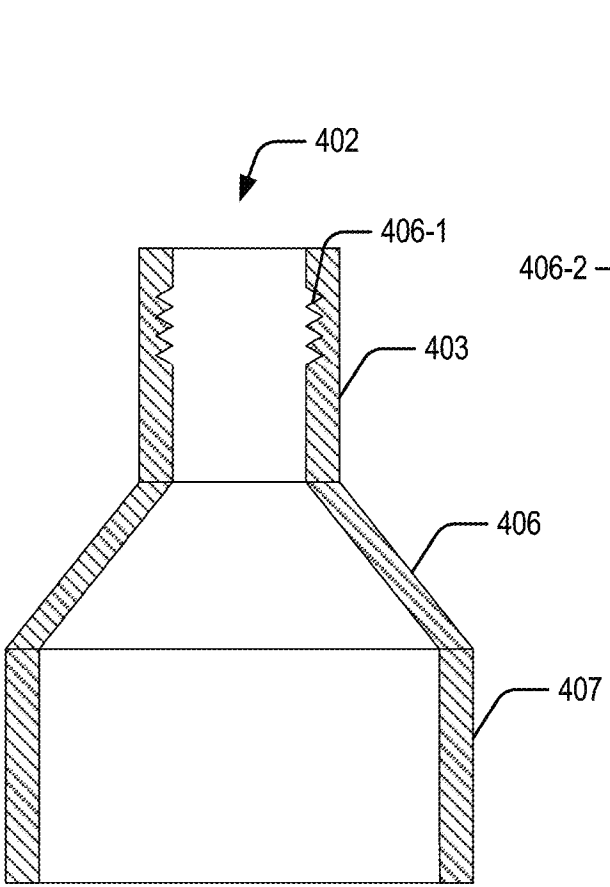

FIGS. 4A, 4B, and 4C illustrate a variant of a water dispenser 400, according to another embodiment. FIG. 4A illustrates an embodiment of the housing 402 of the water dispenser 400, FIG. 4B illustrates a side view of an embodiment of the core 404 of the water dispenser 400, and FIG. 4C illustrates a bottom view of the core 404.

As in the embodiment of FIGS. 3A and 3B, the housing 402 has a tubular shaped neck section 403, a tube-shaped splash-containing section 407 of a larger diameter than the neck section 403, and a frusto-conical section 406 joining the neck section 403 to the cylindrical portion 407. The neck portion 403 in this embodiment has internal threads 406-1 that mate to the threads 406-2 on the core 404 (FIG. 4B) in order to attach the core 404 to the housing 402. Other means for attaching the core 404 to the housing 402 are possible, keeping in mind that the attachment must provide a number of water channels, as discussed in connection with FIG. 4C.

As seen in FIG. 4B, the core 404 includes a cylindrical portion 408, adapted to be connected to a hose, and a tubular portion 418 of a smaller diameter than the internal diameter of the cylindrical portion 408. The tubular portion 418 is fixed to the cylindrical portion 408 in this embodiment by wings 422. As indicated above, external threads 406-2 that mate the internal threads 406-1 on the housing 402 provide in this embodiment a way of attaching the core 404 to housing 402.

Referring to FIG. 4B and FIG. 4C, the core 404 also includes a magnet 420 fixed on the tubular portion 418. As indicated above in connection with FIGS. 3A and 3B, the magnet 420 may be attached to the tubular portion 418 in a variety of ways. As well, the magnet 420 can be a rare-earth magnet, such as neodymium magnets, having a magnetic field that is strong enough to firmly attach the water dispenser 400 to the compressor 105 for as long as water is being dispensed over the compressor, while being light enough for a technician to carry about between service calls, attach to compressors at the start of service calls, and then remove from compressors at the end of service calls, without permanently altering any part of the ACU 101 including the compressor 105. The shape and size of magnet 420 are shown in FIG. 4B for illustrative reasons only; the magnet, as indicated above, may have a different shape and size, being selected with a view to ensure that it keeps the water dispenser on the compressor during the compressor cooling operation and that its free end protrudes over the housing 402 to leave a fluid opening 320 (shown in FIG. 3A).

The core 404 also includes threads 412 (shown in FIG. 4B) on an internal surface of the cylindrical portion 408 of core 404 provided to connect with corresponding threads on the water hose, such as water hose 204 shown in FIG. 2. The threads may be provided on the external surface of cylindrical portion 408 (not shown) for matting with a respective connector on the water hose.

In the embodiment of FIGS. 4A-4C, the water from the hose passes through the cylindrical portion 408 and then through four channels formed by the four wings 422, namely water channels 424-1, 424-2, 424-3, and 424-4, that direct the cooling water towards the compressor 105. Although the illustrated embodiment shows fours wings and fours channels, it may be understood that different number of wings can be provided to form a corresponding number of channels.

In this embodiment, the size of the cylindrical portion 408 and placement of the zone where the wings 422 form the water channels are selected to ensure that the water is redirected by the frusto-conical section 406 to exit the housing in an even coating.

Figure 5A:
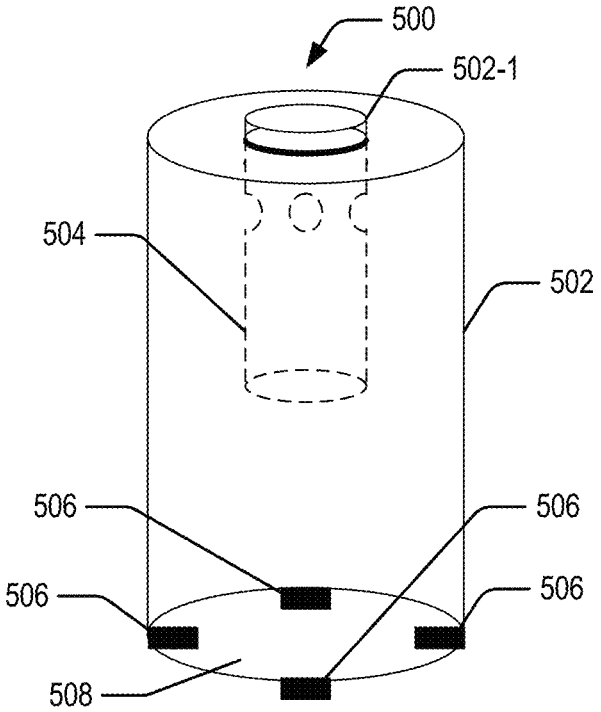
FIGS. 5A and 5B illustrate another possible embodiment of the water dispenser with a cylindrical housing and magnet attached thereto.
Figure 5B:
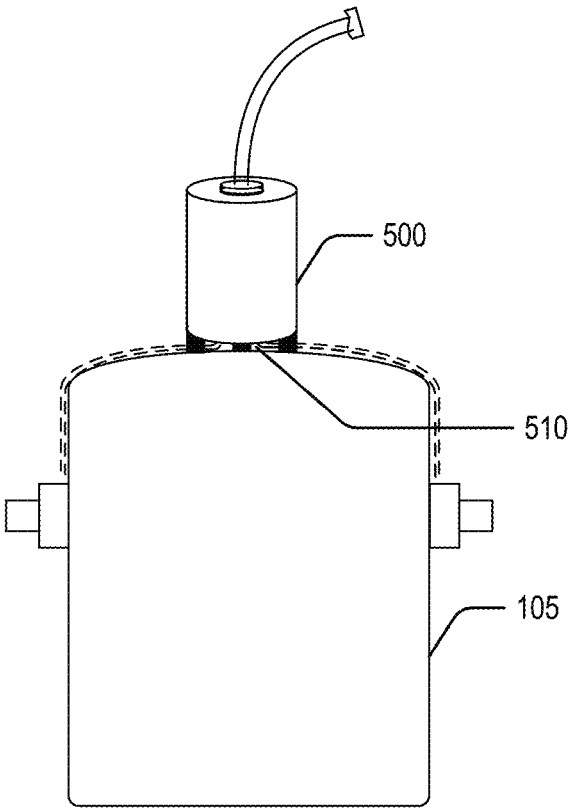

FIG. 5A-5B illustrates another variant of a dispenser 500, according to another embodiment. In the illustrated embodiment, the magnets are mounted on the edges of an end of the splash guard instead being inside the core (see FIG. 3A). Accordingly, FIGS. 5A and 5B illustrates the dispenser 500 that includes a cylindrical shaped splash guard 502 with a connector 502-1 and a core 504 (shown in phantom lines). In one example, the core 504 of the water dispenser 500 can similar to the core 310 but with a difference that one end of the core 310 does not protrude from the splash guard 500. Other than that, the core 504 of the dispenser 500 includes tubular piece 312 which further includes a hose end 312-1 (see FIG. 3A) and other components of the core 310 (see FIG. 3A). In the illustrated embodiment, the splash guard 302 includes a plurality of magnets 506 mounted on an open end 508 of the splash guard 302. Further, the magnets 506 are installed at the open end 508 such that the magnets 506 protrudes from the open end 508 and forms an opening 510 when placed on the compressor 105 as shown in FIG. 5B. Although the illustrated embodiments only show four magnets attached to the open end 508, the water dispenser 500 can have less than four magnets or can have more than four magnets. In another example, the water dispenser 500 includes a ring-shaped magnet mounted on a circumference on the open end 508.

Figure 6A:
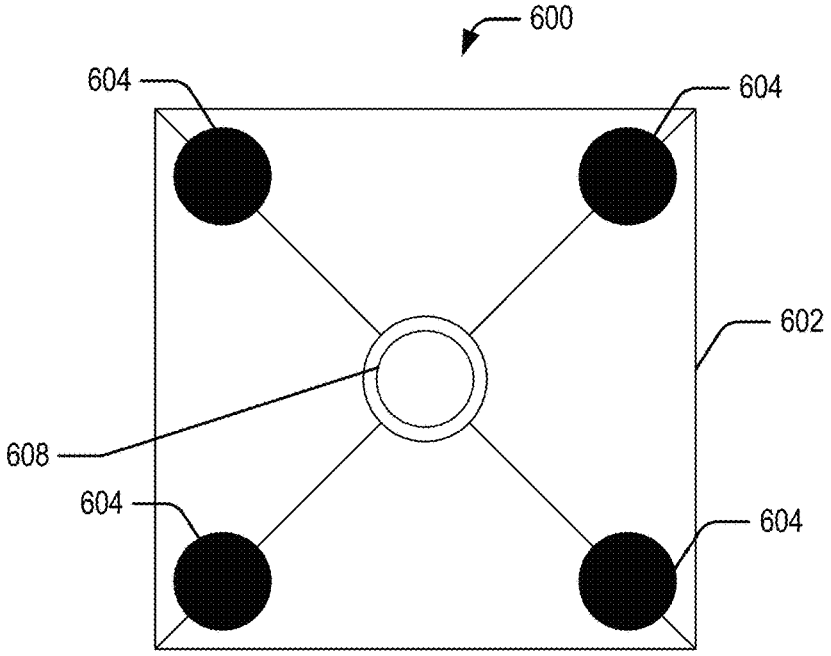
FIGS. 6A and 6B illustrate another possible embodiment of the water dispenser with a frustum shaped housing and magnet attached thereto.
Figure 6B:
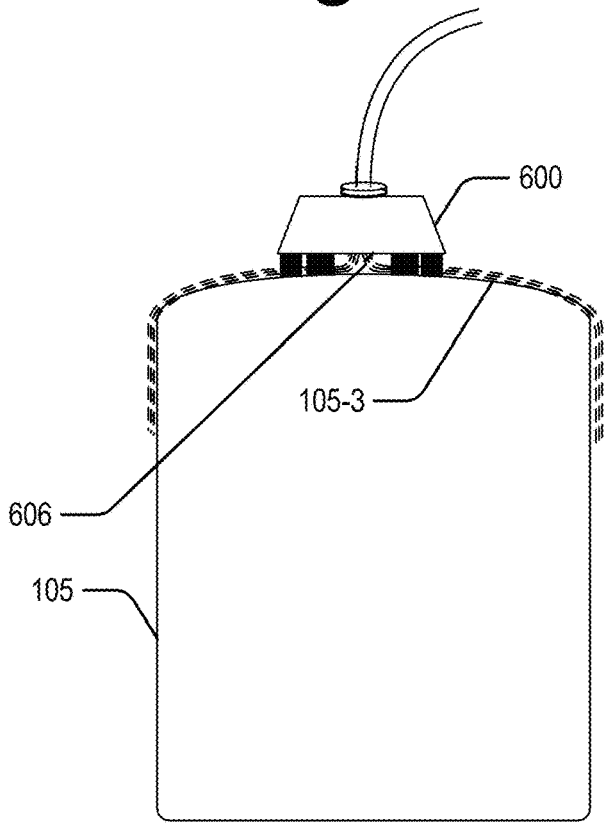

FIG. 6A-6B illustrates another variant of a water dispenser 600, according to another embodiment. FIG. 6A illustrates a bottom view of the water dispenser 600 while FIG. 6B illustrates the water dispenser 600 placed on top of the compressor 105. The water dispenser 600 is similar to the water dispenser 500 shown in FIG. 5A-5B with small difference in the shape of the splash guard 602. In the illustrated embodiment, the splash guard 602 of the water dispenser 600 is shaped of a frustum with at least four surfaces. In addition, the water dispenser 600 include a set of four magnets 604 that are placed on each corner of the splash guard 602 that protrudes from an open end 604 of the splash guard 602 such that an opening 606 is created between the top surface 105-3 of the compressor 105 and the water dispenser 600. The water dispenser 600 also includes a core 608 that may be similar to the core 504.

Figure 7:
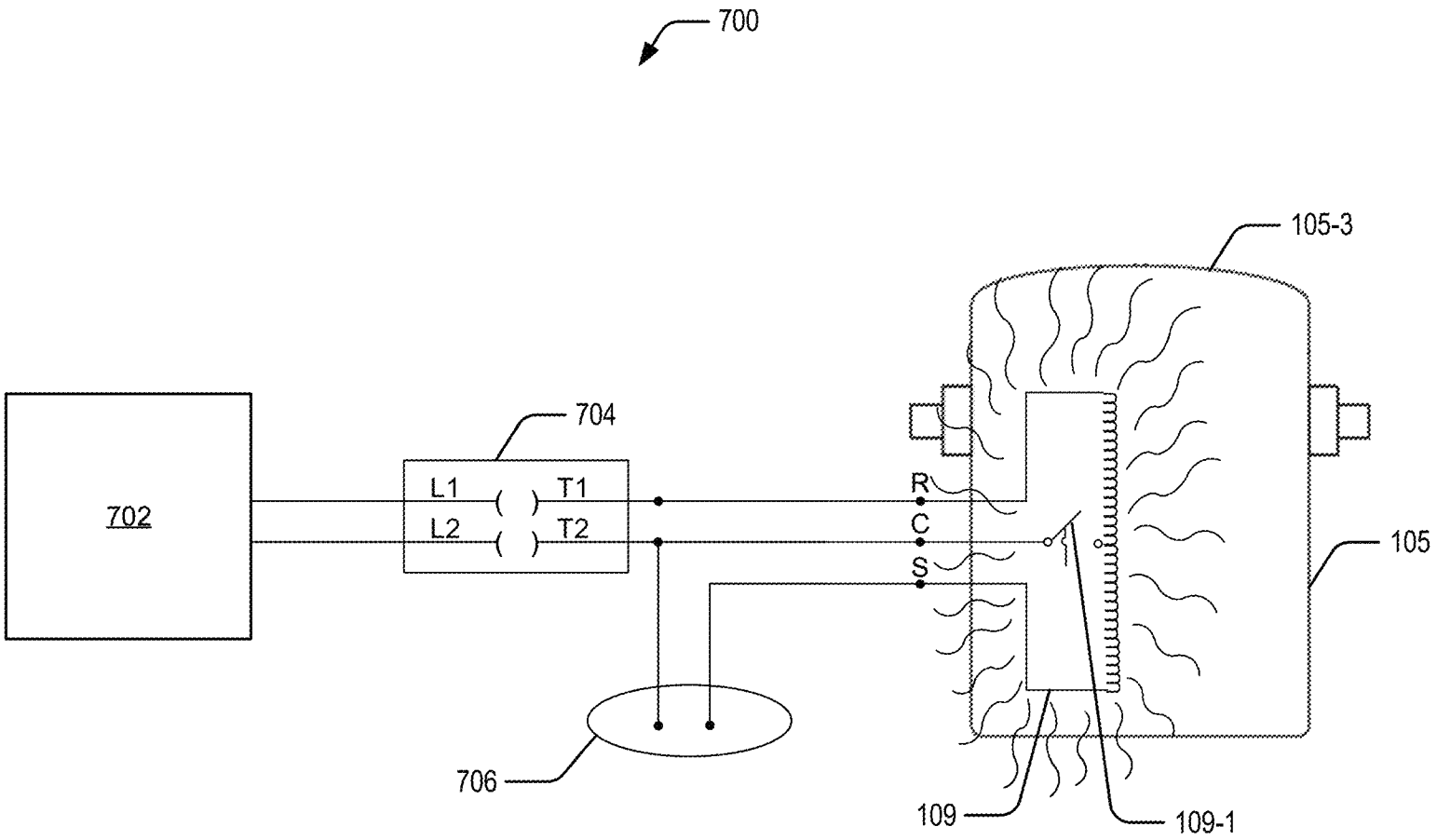
FIG. 7-9 illustrates an operation of the water dispenser, according to an embodiment of the present invention.
Figure 8:
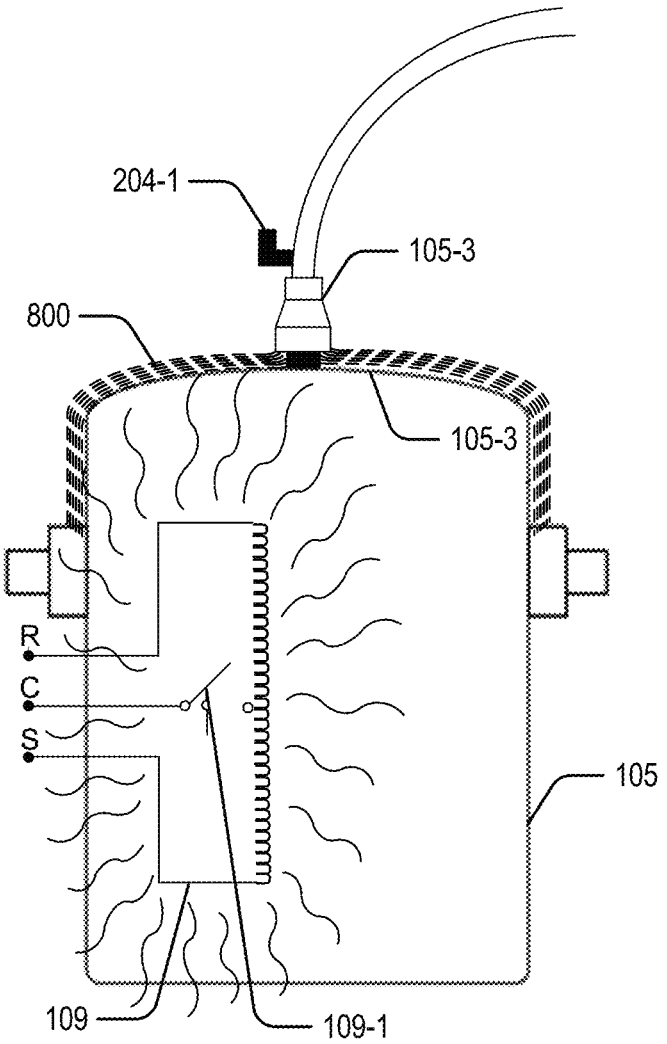
Figure 9:
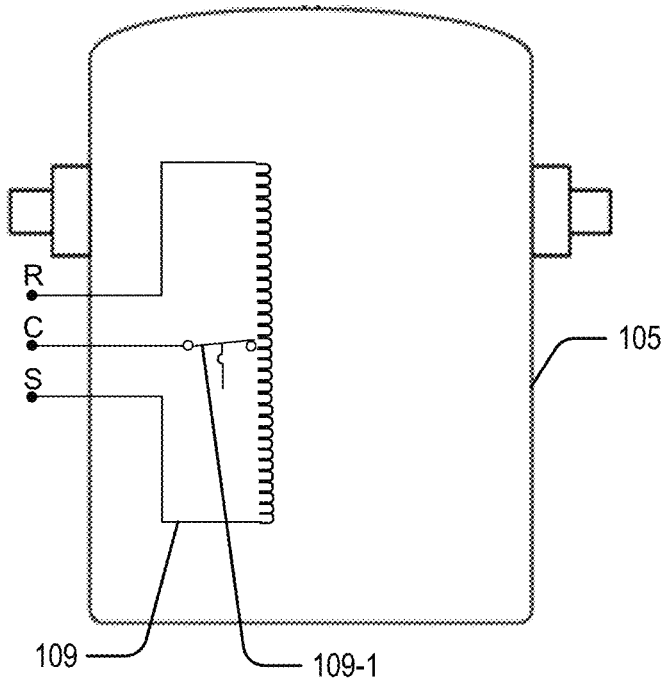

The operation of the water dispenser 200 of FIGS. 3A and 3B is described next with respect to FIGS. 7, 8, and 9. It should be noted that the operation of the water dispenser 200, 400, 500, and 600 are similar and the operation is explained with respect to the water dispenser 200 only. In one example, the compressor 105 is a part of an electrical circuit 700 that includes a source 702, such as AC mains, a contactor 704, a run-capacitor 706, and the thermal overload protection relay 109 of the compressor 105. The thermal overload protection relay 109 also includes an overload switch that opens or closes the electric circuit 700 based on a temperature of the compressor 105. Referring to FIG. 5, the source 702 includes a neutral line L1 and a live line L2, such that a neutral line L1 is connected to a neutral terminal T1 of the contactor 704 while the live line L2 of the source 702 is connected to a live terminal T2 of the contactor 704. Further, the neutral terminal T1 is connected to the terminal 'R' of the thermal overload protection relay 109 and the live terminal T2 is connected to the terminal 'C' of the thermal overload protection relay 109. The electrical circuit 700 also includes a run-capacitor 706 that includes one terminal connected to the live terminal T2 and another terminal connected to the terminal 'S'. Initially, the compressor 105 is drawing electric current from an electrical source 700, for instance, a power socket through the contactor 704. In one example, the electric current is sent to the motor inside the compressor 105 through the thermal overload protection relay 109. Specifically, the current is drawn by the terminal C of the thermal overload protection relay 109.

At one point of during the operation of the compressor, the compressor 105, due to continuous working, gets overheated and the rise in temperature is sensed by the thermal overload protection relay 109. As a result, overheating of the compressor 105 triggers the overload switch 109-1 of the thermal overload protection relay 109 to break the circuit so that no current is not drawn by the motor inside the compressor 105 as shown in FIG. 5. Furthermore, the thermal overload protection relay 109 will remain open until the compressor 105 is cooled down. In order to cool the compressor 105, the water dispenser 200 is placed on the outer surface 105-3 of the compressor 105. An example of how the water dispenser 200 is attached is explained in next paragraph.

In one example, the water hose 204 is coupled to the connector 322 and the water dispenser 200 is placed on top of the compressor 105 as shown in FIG. 6. As mentioned before, the magnet 314 firmly attaches to the metallic outer surface of the compressor 105, leaving the fluid opening 320 between the splash guard 302 and the surface of the compressor 105. The fluid opening 320 allows the cooling water to exit the water dispenser 200 without being blocked. In case of the water dispenser 500 or 600, the magnets 504 or the magnets 604 firmly secures the water dispenser 500 and 600 respectively. Once the water dispenser 200 is firmly attached to the compressor 105, the water tap 204-1 of the water hose 204 is operated to allow cooling water to enter into the water dispenser 200. The cooling water flows into the neck portion 304 of the water dispenser 200 then passes through the tubular piece 312 and is distributed along a plurality of paths through the holes 318. The holes 318 convert the single stream of water entering into the core 310 into four (in the embodiment of FIGS. 3A and 3B) high-pressure water streams 326 (see FIG. 3A) of cooling water.

Next, the high-pressure water streams 326 (see FIG. 3A) exiting the holes 318 are directed towards the compressor 105 by the frustum shaped portion 306 of the splash guard 302, and the splash-containing portion 308 of the housing redirects unwanted splashes that may occur because of the high-pressure water streams 326, towards the compressor 105, thereby preventing water loss. In one example, the splash-containing portion 308 re-configure the high-pressure water streams 326 into a curtain 700 of water. Accordingly, the water that exits the splash-containing portion 308 of splash guard 302 exists from the water dispenser 200 through the fluid opening 320 as a thick coat (a curtain) 700 of the water that flows uniformly over the compressor 105 forming a curtain over the outer surface 105-3. This curtain 700 of cold water efficiently takes away the heat from the compressor 105 thereby effectively cooling the compressor 105. Moreover, since the cooling water flows uniformly across the outer surface 105-3, the cooling of the compressor 105 is achieved efficiently with less time than if the compressor 105 is cooling by itself, or if it is cooled by using a hose to directly apply water to the compressor that either flows at low pressure to minimize splashing or flows at high pressure but then largely splashes off the compressor 105.

The water tap 204-1 is kept open to feed cooling water to the water dispenser 200 until the compressor 105 is cooled to a temperature at which the overload switch 109-1 closes. In another implementation, the water dispenser 500 or 600 remain attached to the. Once the overload switch 109-1 closes, the electrical connection is established and the current starts following to the motor of the compressor 105. Further, the water tap 204-1 is closed to stop flow of water. Thereafter, the water dispenser 200 is detached and removed from the outer surface 105-3 of the compressor 105 as shown in FIG. 7.

The water dispenser presented herein provides an improved method of cooling the compressor of an ACU, particularly in hot climates. As indicated above, in such zones, it may take up to 6 hours for a compressor to cool-down on its own, or over 45 minutes when it is splashed with the water from a garden hose. The water dispenser reduces this time significantly, resulting in a more efficient use of the water and of the user's time.

In addition, the water dispenser proposed here makes the cooling operation much convenient for the user, in that he/she does not need to keep the hose by hand during the cooling process and to maintain manually the water incidence on the compressor at a specific angle and position. Rather, the magnet secures the water dispenser to the compressor, leaving the user free during the cooling time.

Still further, the proposed water dispenser is simple in structure, easy to use and economic, in that it saves water and user's time and it does not need any special training for the ACU technicians. It can be also readily used by the house owner, who may acquire and use the device at little additional cost.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature, or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

What is claimed is:

1. A water dispenser for cooling a compressor of an air conditioning unit (ACU) comprising:

a connector adapted to fluidically couple a hose to the water dispenser;

a core fluidically coupled to the connector, and adapted to dispense water received from the connector, a splash-guard substantially surrounding the core, that is coupled at a first splash-guard end to the core, and that forms with the core a fluid opening at a second splash-guard end, such that a partially enclosed space is defined between the core and the splash-guard; and a magnet having a first magnet-end that is coupled to the core, and a second magnet-end that protrudes from the fluid opening and is adapted for temporary attachment to the compressor, wherein the partially enclosed space and fluid opening are shaped to cause the received water, to exit the water dispenser through the fluid opening as a coating that covers at least part of the compressor.

2. The water dispenser of claim 1, wherein the core includes a tubular piece to house the first magnet-end.

3. The water dispenser of claim 1, wherein the connector is coupled to a part of the core that is proximate to the first splash-guard end.

4. The water dispenser of claim 1, wherein the core includes a plurality of holes to dispense the received water into the partially enclosed space.

5. The water dispenser as claimed in claim 4, wherein the plurality of holes are equidistantly radially spaced.

6. The water dispenser of claim 1, wherein the second magnet-end is shaped to magnetically attach the water dispenser to a surface of the compressor.

7. The water dispenser of claim 1, wherein the first splash-guard end comprises a neck portion, wherein the second splash-guard end comprises a cylindrical portion, and wherein the splash-guard further comprises a frustum shaped portion between the first splash-guard end and the second splash-guard end.

8. The water dispenser as claimed in claim 7, wherein the core is coupled to the neck portion by one of a press fit, a threaded joint, and a welded joint.

9. The water dispenser as claimed in claim 1, wherein the core further comprises:

a first cylindrical portion having a first diameter for coupling with the first splash-guard end;

a second cylindrical portion having a second diameter that is smaller than the first diameter, for coupling with the first magnet-end; and a plurality of wings coupling the first portion with the second portion, so as to form a plurality of water channels between the plurality of wings and the fluid opening.

10. The water dispenser as claimed in claim 1, wherein the magnet is a rare earth magnet.

11. A water dispenser for cooling a compressor of an air conditioning unit (ACU) comprising:

a core adapted to receive water form a hose and to equally distribute the water along a plurality of water streams;

a housing containing the core and adapted to re-configure the plurality of water streams into a curtain of water at a fluid opening created between the water dispenser and the compressor when the water dispenser is attached to the compressor;

a connector adapted to couple the hose to the core; and a magnet adapted to attach the water dispenser to the compressor.

12. The water dispenser of claim 11, herein the core comprises a plurality of holes of a similar shape distributed evenly along a circumference of the core.

13. The water dispenser of claim 11 wherein the housing including a neck portion, a frustum shaped portion extending from the neck portion, and a splash-containing portion, wherein the neck portion is sized for enabling handling of the water dispenser by an operator.

14. The water dispenser of claim 13, wherein the splash-containing portion of the housing is adapted to guide the water from the frustum shaped portion and the core towards the fluid opening.

* * * * *